US005562950A

United States Patent [19]

Dailey et al.

[11] Patent Number: 5,562,950

[45] Date of Patent: Oct. 8, 1996

[54] TIN COATING COMPOSITION AND METHOD

[75] Inventors: James H. Dailey, Kendellville, Ind.; John R. Morgan, Southfield; Karim I. Saad, Rochester Hills, both of Mich.

[73] Assignee: Novamax Technologies, Inc., Ontario, Canada

[21] Appl. No.: 217,378

[22] Filed: Mar. 24, 1994

[51] Int. Cl.[6] ..... B05D 1/18

[52] U.S. Cl. ..... 427/437; 427/436; 427/443.1; 106/1.22

[58] Field of Search ..... 427/435, 436, 427/437, 443.1; 106/1.22, 1.25, 1.27

[56] References Cited

U.S. PATENT DOCUMENTS

| | | | |
|---|---|---|---|
| 2,947,639 | 8/1960 | Balden | 106/1 |
| 3,594,197 | 7/1971 | Bunevich et al. . | |
| 4,192,722 | 3/1980 | Schardein et al. . | |
| 4,269,625 | 5/1981 | Molenaar . | |
| 4,346,128 | 8/1982 | Loch | 427/328 |
| 4,550,037 | 10/1985 | Kinkelaar et al. | 427/443.1 |
| 4,715,894 | 12/1987 | Holtzman et al. | 106/1.22 |
| 4,935,312 | 6/1990 | Nakayama et al. | 428/642 |
| 5,269,838 | 12/1993 | Inoue et al. | 106/1.22 |

FOREIGN PATENT DOCUMENTS

| | | |
|---|---|---|
| 480720 | 8/1929 | Germany . |
| 1521375 | 8/1969 | Germany . |

*Primary Examiner*—Shrive Beck
*Assistant Examiner*—Brian K. Talbot
*Attorney, Agent, or Firm*—Reising, Ethington, Barnard & Perry

[57] ABSTRACT

Described is an aqueous electroless alkaline pH tin coating composition comprised of a source of tin ions and an effective amount of a sludge control agent that is an organic chelating composition.

7 Claims, No Drawings

TIN COATING COMPOSITION AND METHOD

TECHNICAL FIELD

The present application pertains to an aqueous alkaline pH immersion or electroless tin coating composition onto metallic substrates, in particular, aluminum.

BACKGROUND ART

U.S. Pat. No. 2,947,639 pertains to an immersion tin plating coating composition which utilizes metal phosphates to reduce the formation of tin dioxide sludge. The '639 patent utilizes compositions that are highly undesirable from an environmental perspective. Phosphate systems are to be avoided due to substantial environmental concerns.

Previous tin coating compositions had a tendency to produce insoluble sludge or particles which were highly undesirable. Such coating compositions resulted in inconsistent coating films as well as poor adhesion of the tin film onto the substrate, in particular, an aluminum substrate.

When shaped articles of aluminum such as pistons and the like were coated with tin, frequently poor adhesion of the coating was the result due to the sludge that is present in the bath.

Other difficulties associated with coatings for aluminum would be the use of environmentally undesirable materials such as chromates or cyanide and the like. In addition, coatings have been applied to metallic substrates such as aluminum or other light metals as magnesium and titanium by an electrolytic technique. Such electrolytic techniques have substantially different problems associated with it not the least of which is having the parts properly handled from an electrolytic perspective, grounding of the tank and the overall difficulties associated with an electrolytic system, such as safety hazards with such current flows.

It has been described previously that one of the most significant problems encountered in attempting to tin plate aluminum castings resides in the aggressive nature of hot alkaline (pH=13), tin plating solutions wherein the solution tends to attack the porous cast aluminum substrate producing excessive accumulations from corrosion products and severe etching of a cast aluminum substrate; both constituting problems which result in severe blistering, peeling and/or flaking of the plated deposits (U.S. Pat. No. 4,346,128, columns 18–19).

Most tin coating compositions have generally been on the acidic side due to the perceived difficulties with alkaline composition (see U.S. Pat. Nos. 4,550,037, 4,935,312, and 4,715,894).

It is an object of the present invention to provide a good tin coating onto metallic substrates such as aluminum and aluminum alloys with good adhesion and a decrease in sludge formation at alkaline pH.

It is an object of the present invention to apply alkaline tin electroless coatings to aluminum and aluminum alloys utilizing chelating agents that are comprised preferably of polyamine materials, such as amino carboxylic acid materials.

The above objects and other objects, features, and advantages of the present invention are readily apparent from the following detailed description of the best mode for carrying out the invention.

SUMMARY OF THE INVENTION

Disclosed is an electroless alkaline tin coating composition comprised of a source of tin ions and an effective amount of a sludge control agent that is an organic chelating composition. Preferably, the tin coating composition is phosphate-free, fluoride ion-free and cyanide-free. Even more preferably, the coating composition contains organic polyhydroxy materials which assist in the dissolution of aluminum.

The invention is further comprised of a concentrate tin coating composition which is a makeup coating composition or a replenisher coating composition containing a source of tin ions and an effective amount of a sludge control agent that is an organic chelating composition, preferably a polyamine present in aqueous alkaline pH compositions.

The invention is also concerned with a method for coating metallic substrates, in particular, aluminum and aluminum alloy containing substrates wherein one provides the tin coating composition as described above in a bath; inserting the substrate to be coated into the bath; and coating the substrate with tin in an electroless manner and recovering the tin coated product.

BEST MODE FOR CARRYING OUT THE INVENTION

The coating composition of the present invention is an alkaline electroless immersion coating composition. The source of tin ions is preferably an aqueous solution of alkali stannate such as potassium or sodium stannate ($Na_2SnO_3$). Other sources of tin can be any water soluble tin composition such as stannate chloride, stannate sulfate, stannate formate, stannate acetate, and the like.

The sludge control agent is an organic chelating agent. Preferably, a polyamine is utilized. The polyamine must be one that is soluble in the alkaline pH of the aqueous tin coating composition. Suitable polyamines are amino carboxylic acids and the like such as ethylene diamine tetraacetic acid. The acid may likewise have alkali soluble salts such as sodium or potassium or lithium salts. Other suitable amines are nitrilotriacetic acid derivatives (NTA). Other suitable amines could be diethylenediamine, triethylenediamine, tetraethylenetriamine, and the like. Suitable chelating agents may be those that are described in Kirk-Othmer, *ENCYCLOPEDIA OF CHEMICAL TECHNOLOGY*, 3rd Edition, Vol. 5, pp. 339–368, hereby incorporated by reference. Other amino carboxylic acids that may be utilized are hydroxyethylethylenediaminetriacetic acid, N,-N-dihydroxyethylglycine, ethylenebis (hydroxyphenyl glycine), as well as a variety of amino acids such as glycine, serine, cysteine, tyrosine, aspartic acid, glutamic, lysine, histidine, and the like.

Immersion plating refers to a displacement chemical plating process in which the basis metal goes into the solution as the metal solution plates out. Immersion plating is characterized by a limited plating thickness stopping when the solution can no longer "see" the basis metal.

The tin coating composition is also comprised of an effective adhesion promoting amount of a polyhydroxy material. The polyhydroxy material also inhibits the precipitation of tin oxide during the plating process, thereby promoting adhesion of tin. Suitable polyhydroxy materials are sugars that are water soluble having 3–6 carbon atoms as monosaccrides or disaccrides or polysaccrides. A preferred material is glycerin which is a triol. The polyhydroxy materials can be those that contain two hydroxy groups or more. Suitable materials are ethylene glycol, propylene glycol, butane glycol and other alkane glycols from 2–6 carbon atoms. Other suitable polyhydroxy compounds are water soluble in the tin plating bath pH such as hydroxy carboxylic acids and alkali metal salts thereof (sodium, potassium and the like) of from 3 to 6 carbon atoms, as, gluconic acid and the like.

It has been found to be highly desirable to have an inorganic buffer that is soluble in the alkaline pH tin coating composition. Such buffers are comprised of borates, carbonates, the free acid and/or alkali metal salts thereof (sodium or potassium), and the like.

It has further been found highly desirable to have an additional metal that is an adhesion promoter. While applicants do not wish to be bound to any theory, it is believed that the molybdenum acts as a catalyst to promote the tin coating onto the aluminum. It is used in an effective adhesion promoting amount. The metal that is preferred is molybdenum and supplied from a source of molybdenum ions such as alkalimolybdenate (as sodium or potassium molybdenate) or molybdic acid and the like.

The preferred treatment procedure for the tin coating process is as follows:

1. clean the substrate;
2. coat the substrate;
3. recover the tin-coated substrate.

With respect to the pre-treatment process or the cleaning process, any well-known commercially available technique may be utilized. Preferably, the metal with which this application is concerned is most preferably aluminum and aluminum alloys although lightweight metals as magnesium and titanium and their alloys may also be considered as possible substrates. With respect to cleaning of aluminum, generally chemical cleaning may be utilized such as solvent degreasers and the like. For suitable trade practices, see *The Metals Handbook*—9th Edition, Vol 5, "Surface Cleaning, Finishing and Coating", published by American Society for Metals, Metals Park, Ohio (1982) and, in particular, pages 571 through and including 579. The degreasing or cleaning step can be performed with various detergents and with or without the use of ultrasonic waves to remove grit or grime.

A preferred cleaning technique is a mild alkaline cleaning which is a non-etching cleaning utilizing Novaclean 1498® or Novaclean PT312® (trademarks of Novamax Technologies, Inc., Atlanta, Ga.).

After the cleaning step, the part is rinsed. It is preferred not to use deionized water because of the cost involved in having such water. It is highly desirable for the present process to use normal municipal water as the rinsing step. Thereafter, the part is inserted into the tin plating bath of the present invention.

The time for the part to be present in the bath can range anywhere from one minute to sixty minutes as desired, preferably, one to ten minutes and, even more preferably, one to five minutes. The temperature of the bath generally is less than boiling and preferably 100°–200° F., and even more preferably, 130°–160° F. While it is believed that ambient temperature and above may be utilized, for preferred adhesion of the deposited tin onto the substrate, a warm bath is preferred at 130°–160° F.

Listed below in Table 1 is a preferred bath composition.

TABLE 1

| COMPONENTS | RANGE (g/l) | PREFERRED RANGE g/l | MOST PREFERRED g/l |
|---|---|---|---|
| Tin ions (calculated as sodium stannate) | 1–600 grams per liter | 25–100 | 32 |
| Organic chelating agent | 1–100 grams per liter | 1–20 | 2.3 |
| Organic polyhydroxy material | 1–300 grams per liter | 1–20 | 8 |
| Inorganic buffering agent | 1–300 grams per liter | 5–25 | 11.5 |
| Adhesion promoter molybdenum | 0.1–100 grams per liter | 0.1–10 | 1 |
| | pH 7.5–14 | 12–14 | |

The compositions described herein are generally made available as concentrates or replenishment compositions having the following components in Table 2:

TABLE 2

Concentrate or Replenishment Bath for Tin-Coating Composition

| COMPONENTS | RANGE wt % | PREFERRED RANGE wt % |
|---|---|---|
| Tin (calculated as sodium stannate) | 20–50% | 25–40% |
| Organic chelating agent | 0.1–10% | 0.5–5% |
| Organic polyhydroxy material | 0.1–10% | 0.5–5% |
| Inorganic buffering agent | 0.1–10% | 0.5–5% |
| Molybdenum | 0.1–10% | 0.1–5% |
| | pH 7.5–14 | 12–14 |
| Water | 40–80% | 60–70% |
| Total 100% | | |

After the plating of the tin onto the substrate, the part is removed from the bath, washed, and then dried. The drying is generally an air dry, although warmer temperatures may be utilized to rapidly volatilize water.

The substrate on which the tin is to be coated is preferably an aluminum substrate such as aluminum pistons. The need for aluminum pistons in an industrialized society requires that the parts be shaped or formed and normally a grease or organic coolant is utilized in the manufacturing process which needs to be removed as recited above. After the grease is removed, then the tin plating process is begun as described above.

Listed below are exemplifications of the invention wherein all parts or parts by weight and all temperatures are in degrees Centigrade unless otherwise indicated.

EXAMPLE 1

A typical process is a two-part system with a liquid make-up and liquid replenisher as described below. The use of liquid materials assures total dissolution and ease of control.

The process has the following steps:

Clean (using the Novamax® cleaner described above)

Cold water rinse

Cold water rinse

Cold water rinse

Plate in immersion tin bath

Cold water rinse

Hot water rinse

Dry

Cleaning: The cleaners are formulated to operate at:

Concentration 2–5% by volume

Temperature 120°–140° F.

Time 1–5 minutes

Tin Plating:

Concentration 20–25% by volume

Temperature 135°–160° F.

Time 1–4 minutes

Bath Make Up

The tank should be clean and free from rust, sludge and scale.

1. Fill the tank ½ full with water.
2. Add the make-up material.
3. Fill to operating level.
4. Heat to recommended temperature.

TABLE 3

| Make Up | |
|---|---|
| COMPONENT | WEIGHT PERCENT |
| Water | 60.77 |
| Tetra-Sodium EDTA* | 0.88 |
| Potassium Carbonate | 2.31 |
| Boric Acid | 1.73 |
| Potassium Stanate | 30.77 |
| Glycerine | 3.08 |
| Sodium Molybdate | 0.45 |
| | 100.00% |
| Specific Gravity | 1.31 @ 70° F. |

*Ethylene Diamine Tetraacetic Acid

Control

The preferred method of bath control is by analysis of the tin content. The bath used is the most preferred from Table 1.

A 1% by volume addition of replenisher (Table 4) or make-up (Table 3) will increase the concentration of the bath by 1.6 gm/l of tin metal.

TABLE 4

| Replenisher | |
|---|---|
| COMPONENT | WEIGHT PERCENT |
| Water | 66.08 |
| Tetra-Sodium EDTA | 0.88 |
| Potassium Carbonate | 0.69 |
| Boric Acid | 0.52 |
| Potassium Stanate | 30.77 |
| Glycerine | 0.92 |
| Sodium Molybdate | 0.14 |
| | 100.00% |
| Specific Gravity | 1.31 @ 70° F. |

For determining the adhesion of immersion tin deposits to the aluminum substrate, the test below has proven dependable in performance tests.

Materials Required

3-M #610 Cellophane Tape

Pencil Grade Soft Rubber Eraser

Procedure

1. Apply a strip of tape about 1½" long to the component to be tested, leaving enough free to grip.
2. Rub the tape vigorously with the eraser to insure 2 firm bond with the tin surface.
3. Pull the tape free with a vigorous motion maintaining a 90° angle to the surface.
4. Apply the tape to a flat black surface to detect the presence of tin.
5. Only 0–5% tin adhering to the tape surface should be deemed acceptable. Such results have been obtained using the aforementioned tin coating composition and method.

It is to be appreciated that other materials may be added to the bath to improve the overall performance of the bath and to increase the adhesion. It may be desirable to add surfactants that are anionic, cationic or amphoteric.

While the forms of the invention herein disclosed constitute presently preferred embodiments, many others are possible. It is not intended herein to mention all of the possible equivalent forms or ramifications of the invention. It is understood that the terms used herein are merely descriptive rather than limiting and that various changes may be made without departing from the spirit or scope of the invention.

What is claimed is:

1. An immersion method of coating a metallic substrate with tin comprising the steps:

providing an aqueous phosphate-free alkaline pH immersion tin coating composition comprised of a source of tin ions and an effective amount of a sludge control agent that is an organic chelating composition in a bath compartment wherein the tin coating composition is comprised as follows:

tin ions (calculated as potassium stannate) from about 1–600 grams per liter;

organic chelating agent from about 1–100 grams per liter;

organic polyhydroxy material from about 1–300 grams per liter;

molybdenum ions from about 0.1–100 grams per liter;

inserting the metallic substrate into the bath compartment and coating the metallic substrate with tin; and recovering the tin-coated product.

2. The method claim 1 wherein the substrate is a lightweight metal selected from the group consisting of aluminum, magnesium and titanium.

3. The method of claim 1 wherein the metallic substrate is comprised of aluminum.

4. The method of claim 3 wherein the aluminum is a fabricated aluminum piston.

5. The method of claim 1 wherein the bath is maintained at a temperature from ambient to less than boiling point.

6. The method of claim 1 wherein the temperature is from 130° to 160° F.

7. The method of claim 1 wherein the tin coating composition is further characterized as cyanide-free and fluoride ion-free.

* * * * *